US008428296B2

(12) United States Patent
Liu et al.

(10) Patent No.: US 8,428,296 B2
(45) Date of Patent: Apr. 23, 2013

(54) BOBBIN AND LOUDSPEAKER USING THE SAME

(75) Inventors: Liang Liu, Beijing (CN); Jia-Ping Wang, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 338 days.

(21) Appl. No.: 12/824,361

(22) Filed: Jun. 28, 2010

(65) Prior Publication Data

US 2011/0038505 A1 Feb. 17, 2011

(30) Foreign Application Priority Data

Aug. 11, 2009 (CN) ..... 2009 1 0109313

(51) Int. Cl.

| | |
|---|---|
| ***H04R 1/22*** | (2006.01) |
| ***H04R 9/02*** | (2006.01) |
| *H04R 1/20* | (2006.01) |
| *H04R 9/06* | (2006.01) |

(52) U.S. Cl.

USPC ..... 381/407; 381/400; 381/409; 381/410; 977/742; 977/949

(58) Field of Classification Search ..... 381/407, 381/400, 401, 403, 405, 409, 410; 977/742, 977/902, 949, 956, 932

See application file for complete search history.

(56) References Cited

U.S. PATENT DOCUMENTS

| | | | | |
|---|---|---|---|---|
| 4,312,118 | A | 1/1982 | Saik et al. | |
| 5,903,658 | A * | 5/1999 | Okazaki et al. | 381/428 |
| 6,808,746 | B1 | 10/2004 | Dai et al. | |
| 7,437,938 | B2 | 10/2008 | Chakraborty | |
| 7,864,977 | B2 * | 1/2011 | Sadaie et al. | 381/407 |
| 8,021,640 | B2 * | 9/2011 | Kim et al. | 423/447.1 |
| 8,058,787 | B2 * | 11/2011 | Ra et al. | 313/310 |
| 8,165,336 | B2 * | 4/2012 | Iino et al. | 381/407 |
| 8,247,055 | B2 * | 8/2012 | Jiang et al. | 428/40.1 |
| 2004/0020681 | A1 | 2/2004 | Hjortstam et al. | |
| 2004/0053780 | A1 | 3/2004 | Jiang et al. | |
| 2005/0079386 | A1 * | 4/2005 | Brown et al. | 428/690 |
| 2005/0178516 | A1 * | 8/2005 | Sekikawa et al. | 162/159 |
| 2006/0099419 | A1 * | 5/2006 | Kwon et al. | 428/375 |

(Continued)

FOREIGN PATENT DOCUMENTS

| | | |
|---|---|---|
| CN | 2282253 | 5/1998 |
| CN | 1270488 | 10/2000 |

(Continued)

OTHER PUBLICATIONS

Xiao et al.,Flexible, Stretchable, Transparent Carbon Nanotube Thin Film Loudspeakers,Nanoletter, vol. 8; No. 12, 4539-4545, Sep. 2008.

*Primary Examiner* — Edgardo San Martin
(74) *Attorney, Agent, or Firm* — Altis Law Group, Inc.

(57) ABSTRACT

A bobbin includes a paper matrix and a plurality of carbon nanotubes dispersed in the paper matrix. A loudspeaker includes a magnetic circuit, a bobbin, a voice coil, a damper, and a diaphragm. The magnetic circuit defines a magnetic gap. The bobbin is located in the magnetic gap and includes a paper matrix and a plurality of carbon nanotubes dispersed in the paper matrix. The voice coil is wounded on the bobbin. The damper is fixed to the bobbin. The diaphragm includes an inner rim fixed to the bobbin and held mechanically by the damper.

17 Claims, 5 Drawing Sheets

U.S. PATENT DOCUMENTS

| | | | | |
|---|---|---|---|---|
| 2007/0166223 | A1 | 7/2007 | Jiang et al. | |
| 2008/0248235 | A1 | 10/2008 | Feng et al. | |
| 2008/0297878 | A1* | 12/2008 | Brown et al. | 359/263 |
| 2008/0304694 | A1 | 12/2008 | Hayashi | |
| 2009/0045005 | A1* | 2/2009 | Byon et al. | 181/167 |
| 2009/0068448 | A1 | 3/2009 | Liu et al. | |
| 2009/0074228 | A1* | 3/2009 | Mango et al. | 381/432 |
| 2009/0116681 | A1* | 5/2009 | Sadaie et al. | 381/401 |
| 2009/0153502 | A1 | 6/2009 | Jiang et al. | |
| 2009/0155467 | A1 | 6/2009 | Wang et al. | |
| 2009/0160799 | A1 | 6/2009 | Jiang et al. | |
| 2009/0197082 | A1 | 8/2009 | Jiang et al. | |
| 2009/0220767 | A1 | 9/2009 | Schlögl et al. | |
| 2009/0272935 | A1 | 11/2009 | Hata et al. | |
| 2010/0224354 | A1* | 9/2010 | Dooley et al. | 165/185 |
| 2010/0329501 | A1* | 12/2010 | Liu et al. | 381/407 |
| 2010/0329502 | A1* | 12/2010 | Liu et al. | 381/407 |
| 2011/0026750 | A1* | 2/2011 | Wang et al. | 381/335 |
| 2011/0038504 | A1* | 2/2011 | Liu et al. | 381/392 |
| 2011/0051984 | A1* | 3/2011 | Liu et al. | 381/394 |
| 2011/0064259 | A1* | 3/2011 | Liu et al. | 381/398 |
| 2011/0069860 | A1* | 3/2011 | Liu et al. | 381/413 |
| 2011/0075878 | A1* | 3/2011 | Liu et al. | 381/394 |
| 2011/0116677 | A1* | 5/2011 | Wang et al. | 381/400 |
| 2011/0139361 | A1* | 6/2011 | Liu et al. | 156/249 |

FOREIGN PATENT DOCUMENTS

| | | | |
|---|---|---|---|
| CN | 2488247 | | 4/2002 |
| CN | 1430785 | | 7/2003 |
| CN | 2583909 | | 10/2003 |
| CN | 1640923 | | 7/2005 |
| CN | 1982209 | A | 6/2007 |
| CN | 101239712 | | 8/2008 |
| CN | 101288336 | | 10/2008 |
| CN | 101288336 | A | 10/2008 |
| CN | 101304945 | | 11/2008 |
| CN | 101321410 | | 12/2008 |
| CN | 101381071 | | 3/2009 |
| CN | 101464759 | | 6/2009 |
| CN | 101497435 | A | 8/2009 |
| CN | 101499328 | | 8/2009 |
| JP | 60-27298 | | 2/1985 |
| JP | 63-49991 | | 12/1988 |
| JP | 7-138838 | | 5/1995 |
| JP | 2002-171593 | | 6/2002 |
| JP | 2002-542136 | | 12/2002 |
| JP | 2003-319490 | | 11/2003 |
| JP | 2004-32425 | | 1/2004 |
| JP | 2004-107196 | | 4/2004 |
| JP | 2006-147801 | | 6/2006 |
| JP | 2007-182352 | | 7/2007 |
| JP | 2007-290908 | | 11/2007 |
| JP | 2009-144158 | | 7/2009 |
| JP | 2009-146420 | | 7/2009 |
| JP | 2009-184910 | | 8/2009 |

* cited by examiner

BOBBIN AND LOUDSPEAKER USING THE SAME

CROSS-REFERENCE TO RELATED APPLICATIONS

This application claims all benefits accruing under 35 U.S.C. §119 from China Patent Application No. 200910109313.X, filed on 2009/8/11, in the China Intellectual Property Office, the contents of which are hereby incorporated by reference. This application is related to commonly-assigned application entitled, "DAMPER AND LOUDSPEAKER USING THE SAME", filed Jun. 28, 2010 Ser. No. 12/824,356.

BACKGROUND

1. Technical Field

The present disclosure relates to a bobbin based on carbon nanotubes, and a loudspeaker using the same.

2. Description of Related Art

A loudspeaker is an acoustic device transforming received electric signals into sounds. The electric signals have enough power to make the sounds audible to humans. There are different types of loudspeakers that can be categorized by their working principle, such as electro-dynamic loudspeakers, electromagnetic loudspeakers, electrostatic loudspeakers and piezoelectric loudspeakers. Among the various types, electro-dynamic loudspeakers have simple structures, good sound quality, and low cost, thus it is most widely used.

Electro-dynamic loudspeakers typically include a diaphragm, a bobbin, a voice coil, a damper, a magnet, and a frame. The voice coil is an electrical conductor, and is placed in the magnetic field of the magnet. By applying an electrical current to the voice coil, a mechanical vibration of the diaphragm is produced due to the interaction between the electromagnetic field produced by the voice coil and the magnetic field of the magnets, to produce sound waves.

To evaluate the loudspeaker, a sound volume thereof is a determining factor. The sound volume of the loudspeaker relates to the power of the electric signals and the conversion efficiency of the energy. It is known that the higher the strength and the Young's modulus, the smaller the density of the bobbin, and the higher the volume of the loudspeaker. However, the material of the bobbin is usually polymer, cloth, non-carbon nanotube paper or composite, which have relatively low strength and Young's modulus. Therefore, the rated power of the conventional loudspeakers is relatively low. In general, the rated power of a small sized loudspeaker is only 0.3 W to 0.5 W. Furthermore, the density of the conventional bobbins is usually large, thereby restricting the improvement of the energy conversion efficiency. Therefore, at present, to increase the rated power and the energy conversion efficiency of the loudspeaker, thereby increasing the sound volume, efforts to improve loudspeakers are focused on increasing the strength and Young's modulus and decreasing the density of the bobbin, that is, to increase the specific strength (i.e., strength/density) and the specific Young's modulus (i.e., Young's modulus/density) of the bobbin.

What is needed, therefore, is to provide a bobbin with high strength and Young's modulus, and a loudspeaker using the same.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
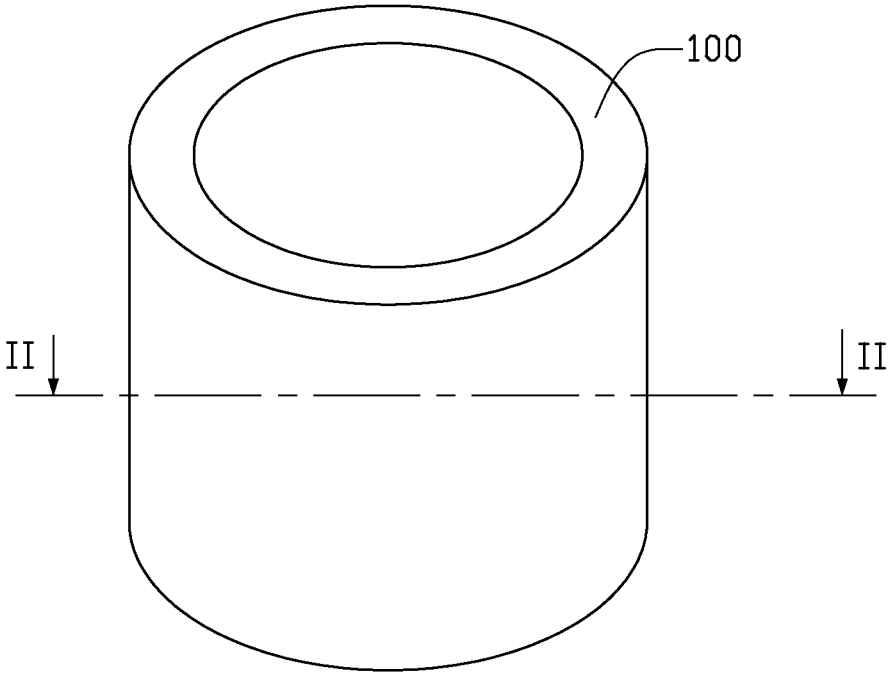
FIG. 1 is a schematic structural view of an embodiment of a bobbin.
Figure 2:
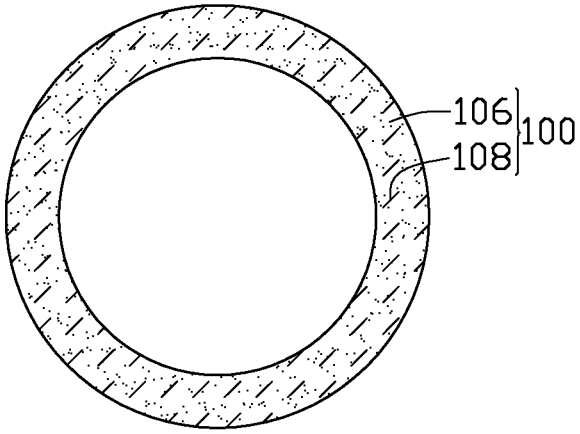
FIG. 2 is a cross-sectional view of the bobbin of FIG. 1, taken along line II-II.

Referring to FIGS. 1 and 2, a bobbin 100 of one embodiment is made of a carbon nanotube paper. The carbon nanotube paper includes a paper matrix 106 and a plurality of carbon nanotubes 108 dispersed in the paper matrix 106.

The paper matrix 106 can include fibers and additives. The fibers can be cellulose fibers, carbon fibers, glass fibers, nylon fibers, polypropylene fibers, cotton fibers, or bamboo fibers. The additive can be hemicellulose, lignin, resin, pigment, pectin, or ash. Any suitable fibers and additive can be used in the bobbin 100.

The carbon nanotubes 108 are uniformly dispersed in the paper matrix 106. The carbon nanotubes 108 can have a plurality of functional groups attached on the wall and/or end portions of the carbon nanotubes 108. The functional groups can be carboxyl groups (—COOH), hydroxy groups (—OH), nitro groups (—$NO_2$), sulfone groups (—$SO_3H$), aldehyde groups (—CHO), or amino groups (—$NH_2$). The functional groups are hydrophilic so that the carbon nanotubes 108 are soluble in a solvent and uniformly dispersed in a paper pulp during a paper making process. The carbon nanotubes 108 can be single-walled carbon nanotubes, double-walled carbon nanotubes, multi-walled carbon nanotubes, or combinations thereof. A diameter of the single-walled carbon nanotubes can range from about 0.5 nanometers to about 50 nanometers. A diameter of the double-walled carbon nanotube can range from about 1.0 nanometer to about 50 nanometers. A diameter of the multi-walled carbon nanotube can range from about 1.5 nanometers to about 50 nanometers. A length of the carbon nanotube 108 can be selected according to need. The length of the carbon nanotube 108 can be greater than 200 micrometers to give greater strength to the bobbin 100 if needed. In one embodiment, a length of the carbon nanotube 108 ranges from about 200 micrometers to about 900 micrometers.

A weight percentage of the paper matrix 106 in the bobbin 100 can range from about 10% to about 99.9%. A weight percentage of the carbon nanotubes 108 in the bobbin 100 can range from about 0.1% to about 90%. In one embodiment, the weight percentage of the paper matrix 106 in the bobbin 100 can range from about 60% to about 90% and the weight percentage of the carbon nanotubes 108 in the bobbin 100 can range from about 10% to about 40%. In one example, the bobbin 100 includes about 70% by weight of the paper matrix 106 and about 30% by weight of the carbon nanotubes 108, and the paper matrix 106 includes cellulose fibers and pectin. In another example, the bobbin 100 includes about 80% by weight of the paper matrix 106 and about 20% by weight of the carbon nanotubes 108, and the paper matrix 106 includes carbon fibers and resin. In another example, the bobbin 100 includes about 85% by weight of the paper matrix 106 and about 15% by weight of the carbon nanotubes, and the paper matrix 106 includes cellulose fibers. In another example, the bobbin 100 includes about 90% by weight of the paper matrix 106 and about 10% by weight of the carbon nanotubes 108, and the paper matrix 106 includes polypropylene fibers and pectin.

The shape and size of the bobbin 100 can be selected according to need. In one embodiment, the bobbin 100 has a hollow cylindrical structure. A diameter and length of the bobbin 100 can be selected according to need. A thickness of a wall of the bobbin 100 can range from about 1 micrometer to about 2 millimeters. The bobbin 100 can be made by hot press method directly or rolling a premade carbon nanotube paper to form a hollow cylindrical structure.

The bobbin 100 made of carbon nanotube paper has at least the following advantages. Firstly, because the carbon nanotubes 108 have greater strength and Young's modulus, the bobbin 100 including a plurality of carbon nanotubes 108 has greater strength and Young's modulus. Secondly, because the carbon nanotubes 108 are light, the bobbin 100 including a plurality of carbon nanotubes 108 has relatively lower weight. Thirdly, because the carbon nanotubes 108 have relatively greater flame resistance and waterlogging resistance, the bobbin 100 including a plurality of carbon nanotubes 108 has relatively greater flame resistance and waterlogging resistance.

The method for making the bobbin 100 of one embodiment includes:

step (a), providing a paper pulp;

step (b), adding carbon nanotubes in the paper pulp to obtain a mixture;

step (c), making a carbon nanotube paper using the mixture; and step (d), fabricating a hollow cylindrical structure using the carbon nanotube paper.

In step (a), a plurality of fibers is pulped in a pulping device (not shown) to obtain a paper pulp. A time for pulping the fibers can be longer than 5 hours. In one embodiment, 20 grams of cellulose fibers and 1500 grams of water are put in the pulping device to be pulped for 10 hours.

The principal functions of pulping are to dissolve lignin that holds the cellulose fibers together and to separate the cellulose fibers. The cellulose fibers that are reduced to pulp go through one of two processes. They are either mechanically ground into pulp, or reduced to a pulp by being chipped and cooked in a chemical solution. Chemical methods remove more of the residues. In the chemical process, wood chips are first cooked and heated in a digester, a closed tank operated at high temperature and pressure. In a sulfite process, the chips are pulped under steam pressure in a solution of sulfite salts. The chemical solution consists of caustic soda and sodium sulfide. Cooking time may be long, such as 12 hours. The cooked pulp is then washed to remove the chemicals and screened to remove undigested wood knots and other unwanted materials. Brief chemical cooking with mechanical treatment to separate the fibers produces a higher yield but sacrifices some of the quality of chemically pulped paper. Other machines used to clean the pulp include the vortex machine, in which the pulp is whirled rapidly so that heavy pieces of foreign matter fall to the bottom, and the centrifugal machine, in which the pulp is filtered by means of a vacuum through a wire drum that revolves in the pulp vat, making the pulp cleaner.

In step (b), a plurality of carbon nanotubes and an additive are added to the paper pulp to form a mixture, and then the mixture is kept for a period of time.

The carbon nanotubes can be obtained by a conventional method, such as chemical vapor deposition (CVD), arc discharging, or laser ablation. The carbon nanotubes can be obtained by the substeps of providing a substrate, forming a carbon nanotube array on the substrate by a chemical vapor depositing method, and peeling the carbon nanotube array off the substrate by a mechanical method, thereby achieving a plurality of carbon nanotubes. The carbon nanotubes in the carbon nanotube array are substantially parallel to each other. In one embodiment, about 3.53 grams of carbon nanotubes are added in the paper pulp, and then the mixture is kept for a period of time ranging from about 1 day to about 3 days. The mixture can be stirred while the carbon nanotubes are being added to the paper pulp.

Furthermore, the carbon nanotubes can be purified by the substeps of heating the carbon nanotubes in air flow at about 350° C. for about 2 hours to remove amorphous carbons, soaking the treated carbon nanotubes in about 36% solution of hydrochloric acid for about one day to remove metal catalysts, isolating the carbon nanotubes soaked in the hydrochloric acid, rinsing the isolated carbon nanotubes with de-ionized water, and filtrating the carbon nanotubes.

Furthermore, the carbon nanotubes can be treated with an acid with the substeps of refluxing the carbon nanotubes in nitric acid at about 130° C. for a period of about 4 hours to about 48 hours to form a suspension, centrifuging the suspension to form an acid solution with carbon nanotube sediment, and rinsing the carbon nanotube sediment with water until the pH of the used water is about 7. The carbon nanotubes can be chemically modified with functional groups such as carboxyl groups (—COOH), hydroxy groups (—OH), nitro groups (—$NO_2$), sulfone groups (—$SO_3H$), aldehyde groups (—CHO), or amino groups (—$NH_2$) on the walls and/or end portions thereof after the acid treatment. These functional groups can help the carbon nanotubes to be soluble and dispersible in the solvent.

In step (c), the method of making a carbon nanotube paper using the mixture includes the substeps of: step (c1), a carbon nanotube paper preform is formed on a mold or a filter by a method of deposition; and step (c2), a carbon nanotube paper is formed by drying the carbon nanotube paper preform.

Figure 3:
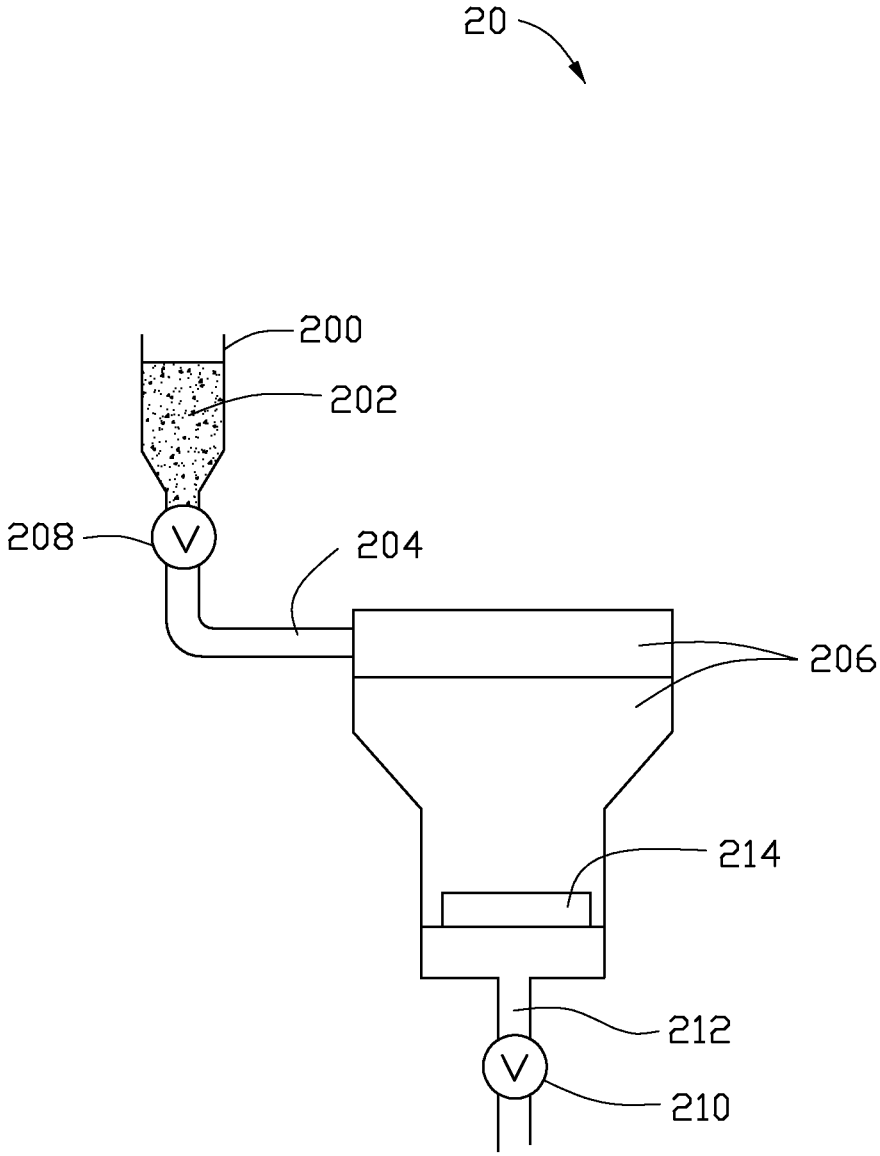
FIG. 3 is a schematic structural view of an embodiment of a paper making device.

Referring to FIG. 3, a paper making device 20 for making the carbon nanotube paper in one embodiment includes a measuring bath 202, a depositing room 206, an input pipe 204, a first valve 208, an output pipe 212, a second valve 210 and a mold 214. The measuring bath 202 is connected to a top position of the depositing room 206 by the input pipe 204. The first valve 208 is disposed in the input pipe 204. One end of the output pipe 212 is connected to a bottom of the depositing room 206. The second valve 210 is disposed in the output pipe 212. The mold 214 is located on an inner bottom surface of the depositing room 206.

In step (c1), the mixture 200 is filled in the measuring bath 202 and then flows into the depositing room 206 through the input pipe 204. The amount of the mixture 200 entering the depositing room 206 can be controlled by the first valve 208. Some water (not shown) is filled in the depositing room 206 to dilute the mixture 200 so that the mixture 200 can be dispersed more uniformly. The water is drained through the output pipe 212 so that the mixture 200 deposits onto the mold 214. A shape and size of the carbon nanotube paper preform depend on a shape and size of the mold 214.

In another embodiment, the mixture 200 can be diluted with water and deposited on a filter (not shown) directly to form a carbon nanotube paper preform.

In step (c2), the carbon nanotube paper preform can be hot pressed so that the remaining water therein is vaporized to form a carbon nanotube paper. In one embodiment, the mold 214 is heated to a temperature ranging from about 100° C. to about 200° C., and a press force ranging from about 1000 newtons to about 6000 newtons is applied on the carbon nanotube paper for about 10 seconds to about 100 seconds. The carbon nanotube paper preform can also be dried in air to obtain a carbon nanotube paper.

In step (d), the carbon nanotube paper is rolled to form a hollow cylindrical structure. In one embodiment, the carbon nanotube paper is wrapped on a surface of a column. The carbon nanotube paper can be wrapped on the surface of the column, layer by layer. A bonding agent can be coated between adjacent layers of the carbon nanotube paper to strengthen layers of the carbon nanotube paper. Furthermore, a step of cutting the hollow cylindrical structure can be carried out in step (d) to obtain a bobbin 100 with certain length.

In another embodiment, the bobbin 100 can be obtained in the step (c) directly by selecting shape and size of the mold 214.

Figure 4:
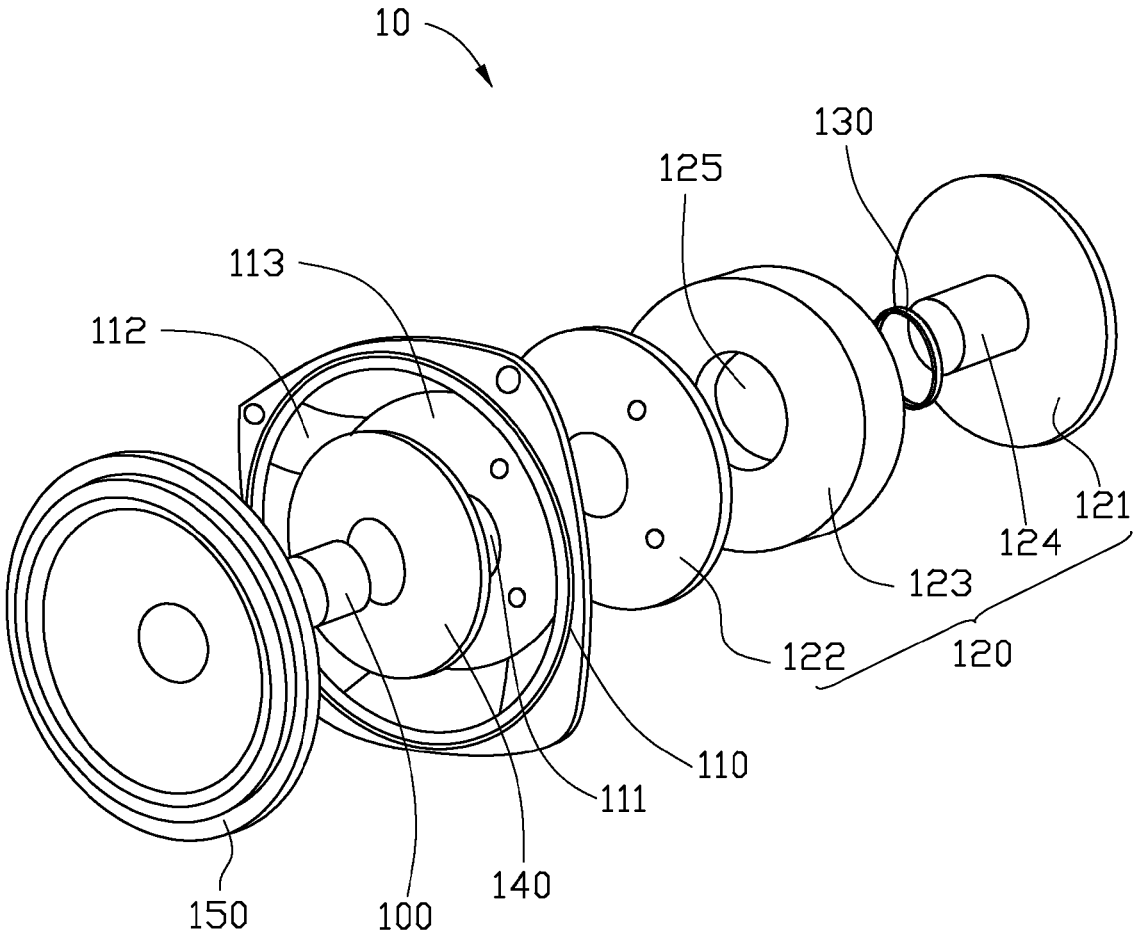
FIG. 4 is a schematic structural view of an embodiment of a loudspeaker.
Figure 5:
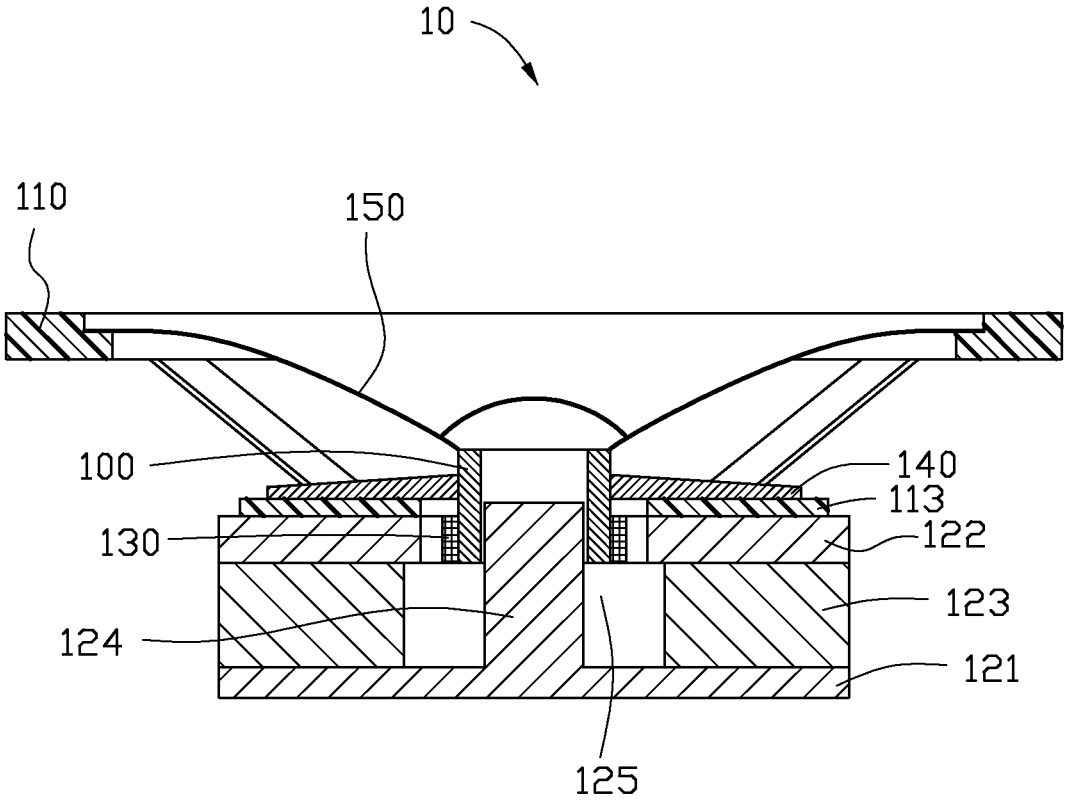
FIG. 5 is a cross-sectional view of the loudspeaker of FIG. 4.

Referring to FIGS. 4 and 5, a loudspeaker 10 of one embodiment includes a frame 110, a magnetic circuit 120, a voice coil 130, a damper 140, a diaphragm 150, and a bobbin 100.

The frame 110 is mounted on an upper side of the magnetic circuit 120. The voice coil 130 is received in the magnetic circuit 120 and wound on the bobbin 100. An outer rim of the diaphragm 150 is fixed to an inner rim of the frame 110, and an inner rim of the diaphragm 150 is fixed to an outer rim of the bobbin 100 placed in a magnetic gap 125 of the magnetic circuit 120.

The frame 110 is a truncated cone with an opening on one end and includes a hollow cavity 112 and a bottom 113. The hollow cavity 112 receives the diaphragm 150 and the damper 140. The bottom 113 has a center hole 111 to accommodate a center pole 124 of the magnetic circuit 120. The bottom 113 of the frame 110 is fixed to the magnetic circuit 120.

The magnetic circuit 120 includes a lower plate 121 having the center pole 124, an upper plate 122, and a magnet 123. The magnet 123 is sandwiched by the lower plate 121 and the upper plate 122. The upper plate 122 and the magnet 123 are both circular, and define a cylindrical space in the magnetic circuit 120. The center pole 124 is received in the space and extends through the center hole 111. The magnetic gap 125 is formed between the center pole 124 and the magnet 123. The magnetic circuit 120 is fixed on the bottom 113 at the upper plate 122.

The voice coil 130 is a driving member of the loudspeaker 10. The voice coil 130 is made of conducting wire. When electric signals are inputted to the voice coil 130, a magnetic field is formed by the voice coil 130 that varies with variations in the electric signals. The interaction of the magnetic field of the voice coil 130 and the magnetic circuit 120 induces the voice coil 130 to vibrate.

The bobbin 100 is a hollow cylindrical structure. The center pole 124 is disposed in the hollow structure and spaced from the damper 140. When the voice coil 130 vibrates, the bobbin 100 and the diaphragm 150 also vibrate with the voice coil 130 to produce pressure waves heard as sound.

The diaphragm 150 has a funnel configuration and is a sound producing member of the loudspeaker 10. The diaphragm 150 can have a cone shape when used in a large loudspeaker 10. If the loudspeaker 10 is small, the diaphragm 150 can have a round or rectangular planar shape.

The damper 140 is a substantially a corrugated round sheet having radially alternating circular ridges and circular furrows. The diaphragm 150 is held mechanically by the damper 140. The damper 140 is fixed to the frame 110 and the bobbin 140. The damper 140 has relatively greater strength in diameter direction, relatively greater elasticity in axial direction, and relatively longer endurance strength. The damper 140 hold the voice coil 130 to freely move up and down but not left and right.

An external input terminal can be attached to the frame 110. A dust cap (not shown) can be fixed over and above a joint portion of the diaphragm 150 and the bobbin 100.

It is to be understood that, the loudspeaker 10 is not limited to the above-described structure. Any loudspeaker of any size and shape using the present diaphragm is in the scope of the present disclosure.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A bobbin comprising:

a paper matrix having a hollow cylindrical structure; and a plurality of carbon nanotubes dispersed in the paper matrix, wherein a length of each of the plurality of carbon nanotubes ranges from about 200 micrometers to about 900 micrometers.

2. The bobbin of claim 1, wherein the paper matrix comprises fibers and an additive.

3. The bobbin of claim 2, wherein the fibers are selected from the group consisting of cellulose fibers, carbon fibers, glass fibers, nylon fibers, polypropylene fibers, cotton fibers, bamboo fibers, and combinations thereof.

4. The bobbin of claim 2, wherein the additive is selected from the group consisting of hemicellulose, lignin, resin, pigment, pectin, ash and combinations thereof.

5. The bobbin of claim 1, wherein a weight percentage of the paper matrix in the bobbin ranges from about 10% to about 99.9%.

6. The bobbin of claim 5, wherein the weight percentage of the paper matrix in the bobbin ranges from about 60% to about 90%.

7. The bobbin of claim 1, wherein the carbon nanotubes are uniformly dispersed in the paper matrix.

8. The bobbin of claim 1, wherein the carbon nanotubes comprise a plurality of functional groups selected from the group consisting of carboxyl groups, hydroxy groups, nitro groups, sulfone groups, aldehyde groups, amino groups, and combinations thereof.

9. The bobbin of claim 1, wherein a weight percentage of the carbon nanotubes in the bobbin ranges from about 0.1% to about 90%.

10. The bobbin of claim 9, wherein the weight percentage of the carbon nanotubes in the bobbin ranges from about 10% to about 40%.

11. The bobbin of claim 1, wherein a thickness of a wall of the hollow cylindrical structure ranges from about 1 micrometer to about 2 millimeters.

12. A loudspeaker comprising:

a magnetic circuit defining a magnetic gap;

a bobbin located in the magnetic gap, the bobbin comprising a paper matrix and a plurality of carbon nanotubes dispersed in the paper matrix, wherein a length of each of the plurality of carbon nanotubes ranges from about 200 micrometers to about 900 micrometers;

a voice coil wound on the bobbin;

a damper fixed to the bobbin; and a diaphragm comprising an inner rim fixed to the bobbin and held mechanically by the damper.

13. The loudspeaker of claim 12, wherein the paper matrix comprises fibers and additive.

14. The loudspeaker of claim 12, wherein a weight percentage of the paper matrix in the bobbin ranges from about 10% to about 99.9%.

15. The loudspeaker of claim 12, wherein the carbon nanotubes comprise a plurality of functional groups selected from the group consisting of carboxyl groups, hydroxy groups, nitro groups, sulfone groups, aldehyde groups, amino groups, and combinations thereof.

16. The loudspeaker of claim 12, wherein a weight percentage of the carbon nanotubes in the bobbin ranges from about 0.1% to about 90%.

17. The loudspeaker of claim 12, wherein the bobbin is a hollow cylindrical structure.

* * * * *